US005162017A

United States Patent [19]

Nordin

[11] Patent Number: 5,162,017

[45] Date of Patent: Nov. 10, 1992

[54] DEVICE FOR CONNECTING AN EXHAUST SUCTION HOSE TO THE EXHAUST PIPE OF A VEHICLE

[75] Inventor: Kurt L. Nordin, Helsingborg, Sweden

[73] Assignee: AB PH, Nederman & Co., Helsingborg, Sweden

[21] Appl. No.: 704,130

[22] Filed: May 22, 1991

[30] Foreign Application Priority Data

May 29, 1990 [SE] Sweden ..... 9001928

[51] Int. Cl.[5] ..... F23J 11/00

[52] U.S. Cl. ..... 454/63; 104/52

[58] Field of Search ..... 104/52; 454/63, 64

[56] References Cited

U.S. PATENT DOCUMENTS 2,733,668 2/1956 Pfetzing ..... 454/63 X
2,772,625 12/1956 Clark, Jr. ..... 454/63
4,660,465 4/1987 Jentzsch et al. ..... 454/64

FOREIGN PATENT DOCUMENTS 8206542-6 10/1983 Sweden .
87035564 3/1989 Sweden .
2002871 2/1979 United Kingdom .

*Primary Examiner*—Harold Joyce

[57] ABSTRACT

A device for connecting an exhaust suction hose (1) to the exhaust pipe (3) of a vehicle (4) in such a way that the exhaust fumes of the vehicle (4) are carried away via the exhaust suction hose (1). The exhaust suction hose (1) being disposed at the top of a workshop or like premises and a dependent part of the exhaust suction pipe (1) being connectable to the exhaust pipe (3) of a vehicle (4) in the premises. The exhaust suction pipe (1) being kept connected to the exhaust pipe (3) while the vehicle is driven about in the premises, and the exhaust suction hose (1) being automatically released from the exhaust pipe (3) when the vehicle (4) is driven out of the premises. To void damage to the exhaust pipe, the exhaust suction hose (1) constitutes and/or cooperates with a tensioning device (12) which can be tensioned by bending and/or stretching an end portion (11) of the exhaust suction hose (1) and which retains the end portion (11) to the exhaust pipe (3) by being tensioned when the exhaust suction hose (1) is attached to the vehicle (4) via a fastening device (10) and when the end portion (11) is passed onto the exhaust pipe (3).

22 Claims, 8 Drawing Sheets

Fig. 5
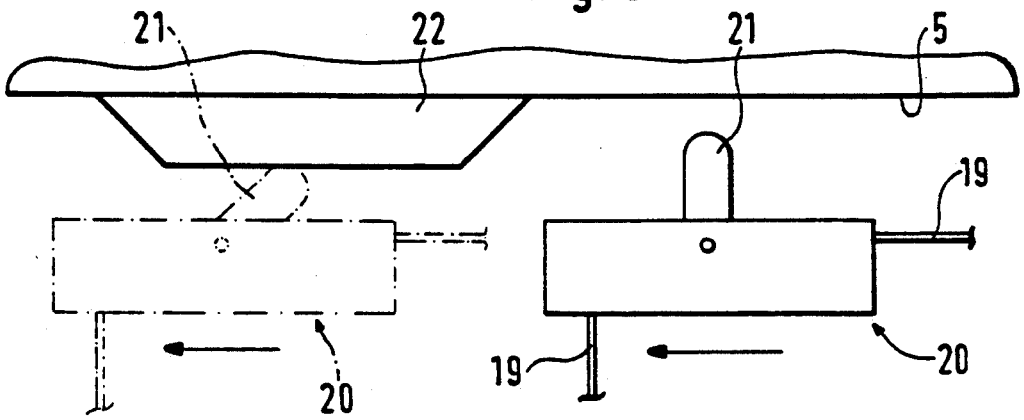
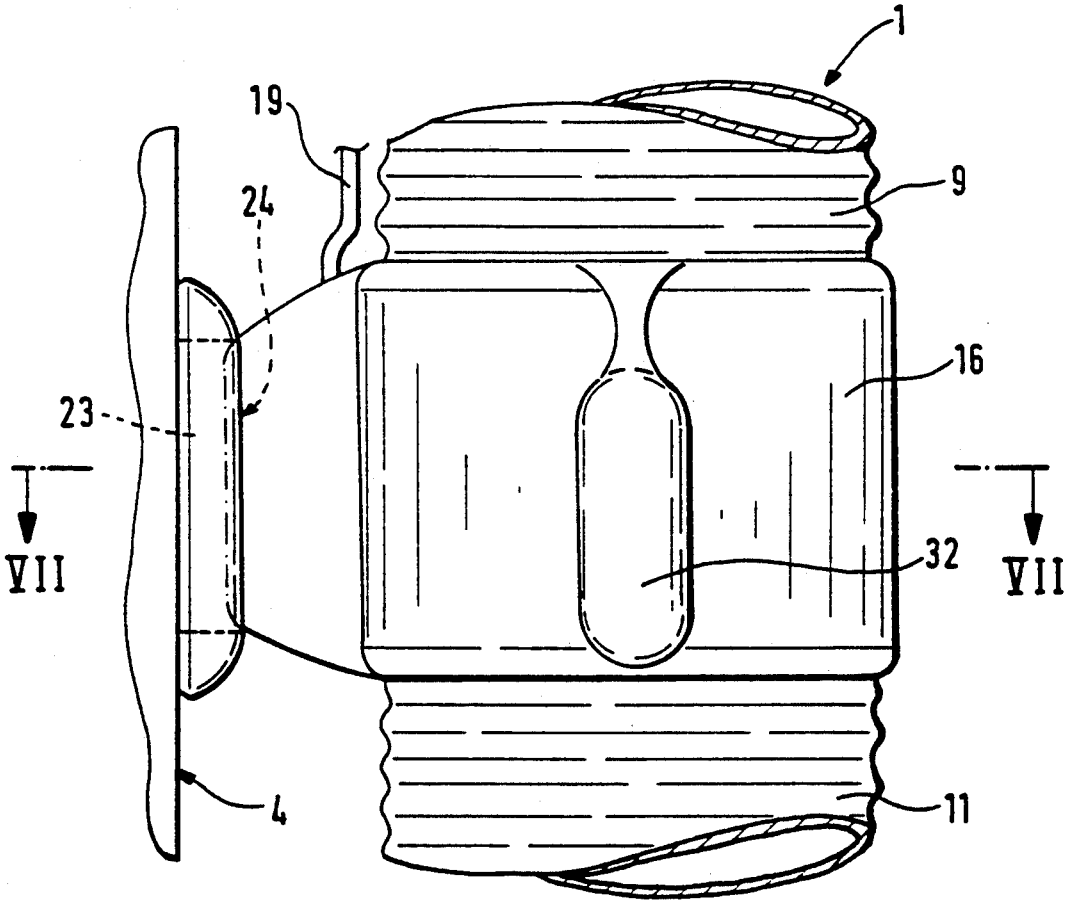
Fig. 6

DEVICE FOR CONNECTING AN EXHAUST SUCTION HOSE TO THE EXHAUST PIPE OF A VEHICLE

This invention relates to a device for connecting an exhaust suction hose to the exhaust pipe of a vehicle in such a way that the exhaust fumes of the vehicle are carried away via the exhaust suction hose, said exhaust suction hose being disposed at the top of a workshop or like premises and a dependent part of the exhaust suction hose being connectable to the exhaust pipe of a vehicle in said premises, the exhaust suction hose is adapted to be kept connected to the exhaust pipe while the vehicle is driven about in said premises, and the exhaust suction hose being automatically released from the exhaust pipe when the vehicle is driven out of said premises.

Devices of the type indicated are already known from SE,B, 430 130, and they have a special nozzle designed to fit the exhaust pipes on which it is to be mounted. The nozzle is equipped with a pliers-type clamping device, which is clamped to the exhaust pipe to maintain the nozzle in position. The pliers-type clamping device is automatically released so that the nozzle slides off the exhaust pipe when the vehicle leaves the premises. This automatic release function is realized by means of a release spring which cooperates with a braking device for decelerating a trolley on which the exhaust suction hose is mounted.

These prior-art devices are associated with some problems that still remain to be solved. One problem is that the pliers-type clamping device may damage the surface of the exhaust pipe. This is unacceptable, considering that nowadays use is often made of exhaust pipes of aesthetically pleasing appearance with sensitive surfaces. There is also the risk that prior-art types of clamping devices get stuck, with resultant damage to the suction device or the exhaust system.

A further problem is that a greater number of different types of nozzles will have to be furnished than earlier because the exhaust pipes have lately been given designs of highly varying appearance. It may be mentioned by way of example, that exhaust pipes of round, oval, square and rectangular section are now available, and of these types there also exist one-barrelled and double-barrelled variants.

Still another problem is that the prior-art releasing device operates only in connection with the pliers-type clamping devices and braking devices for trolleys on exhaust rails.

The object of the present invention is to eliminate the above-mentioned problems and to provide a device that int. al. eliminates the need for pliers-type clamping devices that might damage the exhaust pipes, which are difficult to fit onto various types of exhaust pipes and which require releasing devices which operate only in connection with braking systems for deceleration of trolleys carrying exhaust suction pipes on exhaust rails. This is brought about, according to this invention, substantially by the characteristic features appearing from the appendant claim 1.

The device according to the invention sees to that the exhaust pipe is not damaged when the exhaust suction hose is fitted onto an disconnected from said exhaust pipe while pliers-type clamping devices are no longer needed and neither are complex releasing devices for such pliers-type clamping devices.

The invention will be described more in detail below with references to the accompanying drawings, in which FIG. 1 is a side view illustrating th exhaust suction hose fitted with a device according to the invention;

Figure 1:
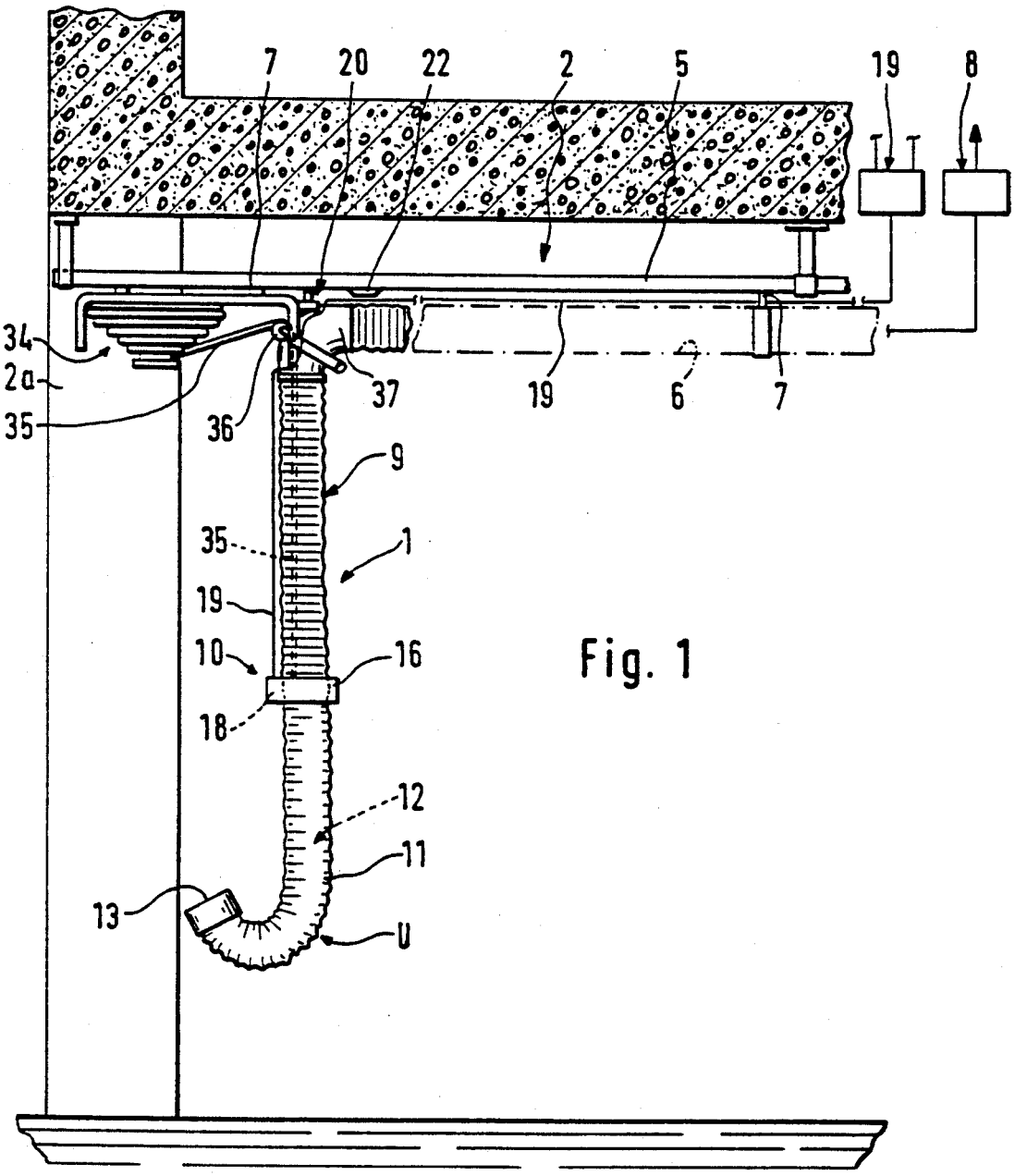
Figure 2:
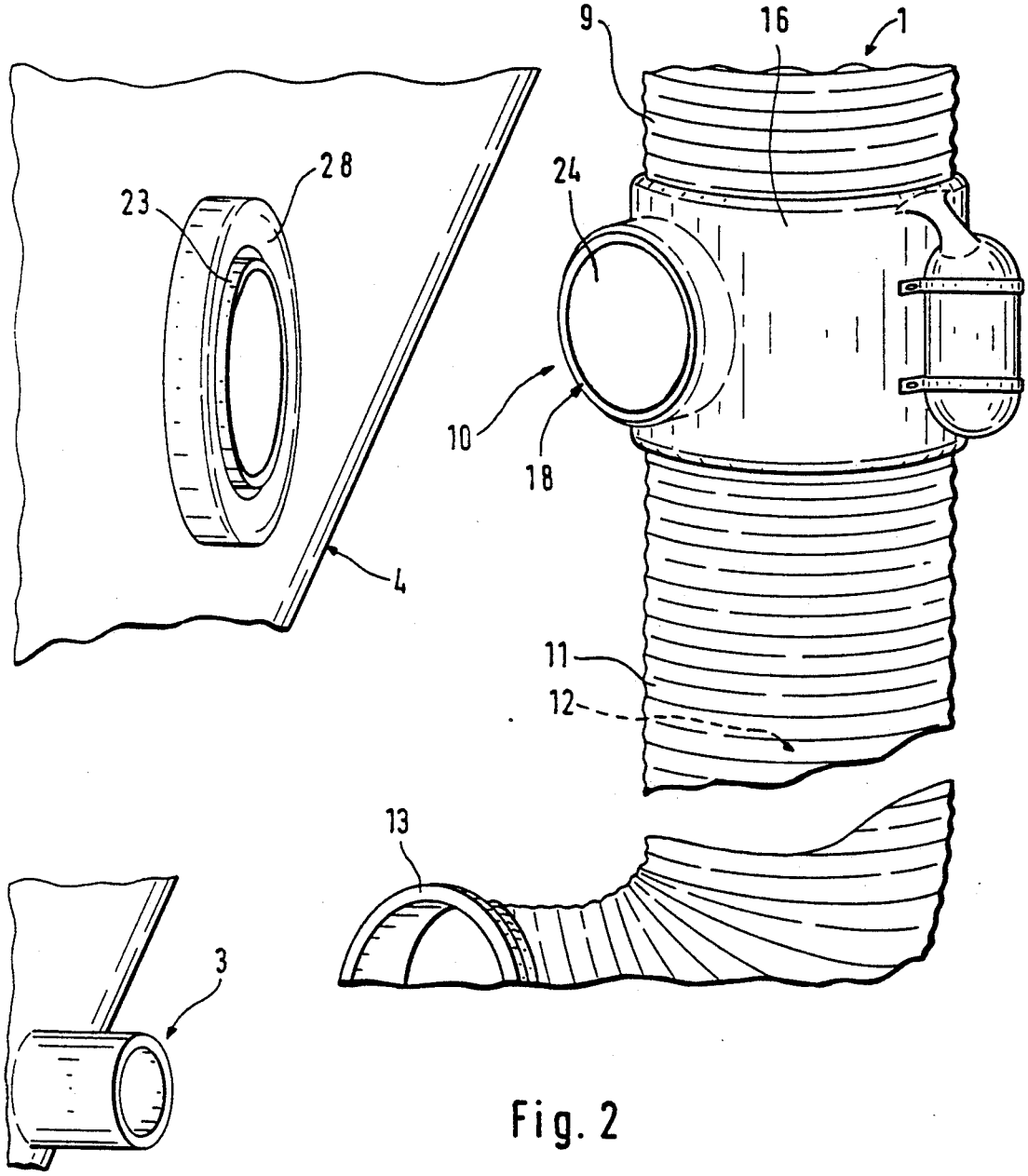
FIG. 2 is a perspective view illustrating part of the exhaust suction hose fitted with the device according to the invention and in close proximity to a vehicle.
Figure 3:
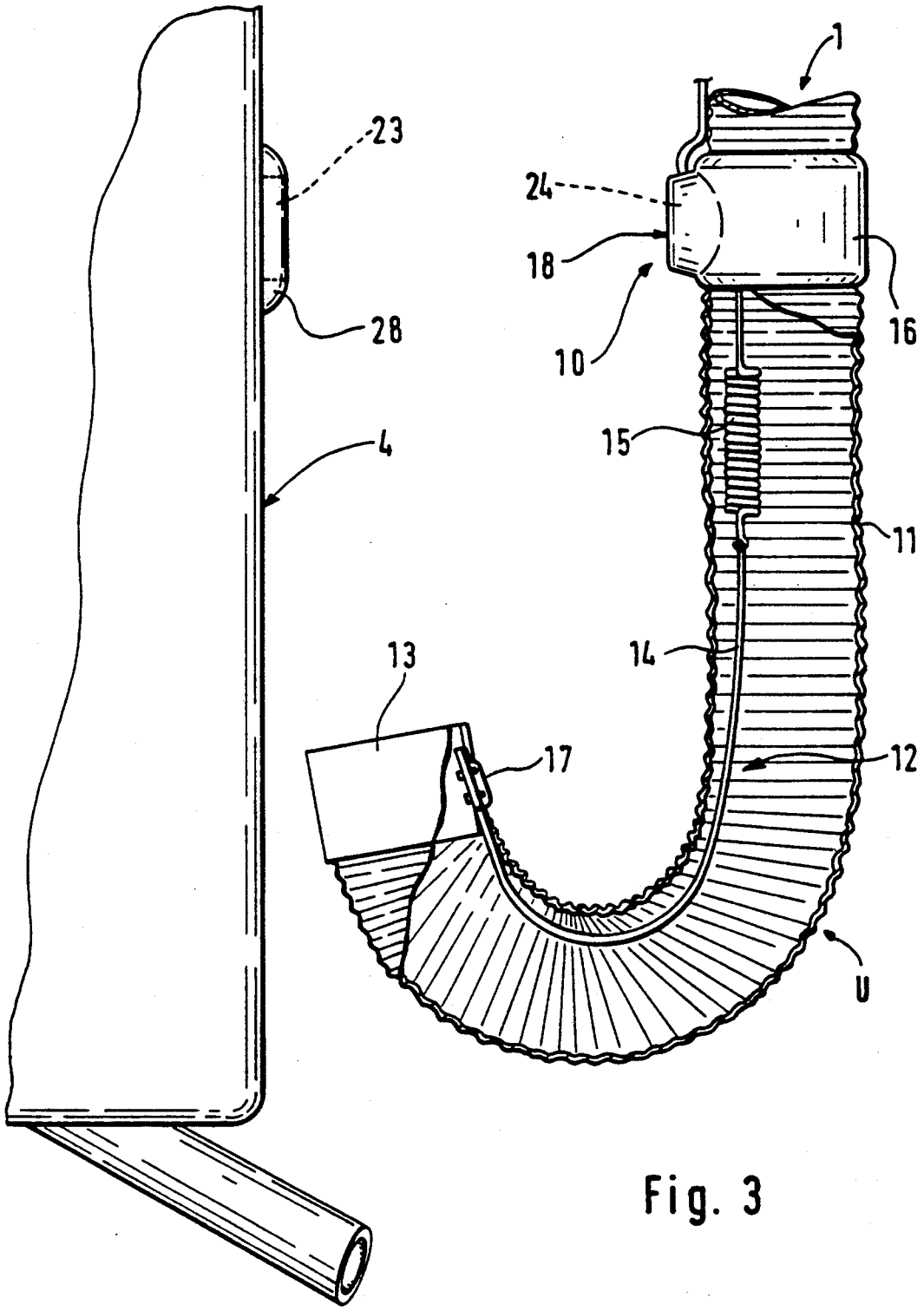
FIG. 3 is a side view, partly in section, illustrating part of the exhaust suction hose fitted with the device according to the invention and in close proximity to a vehicle.
Figure 4:
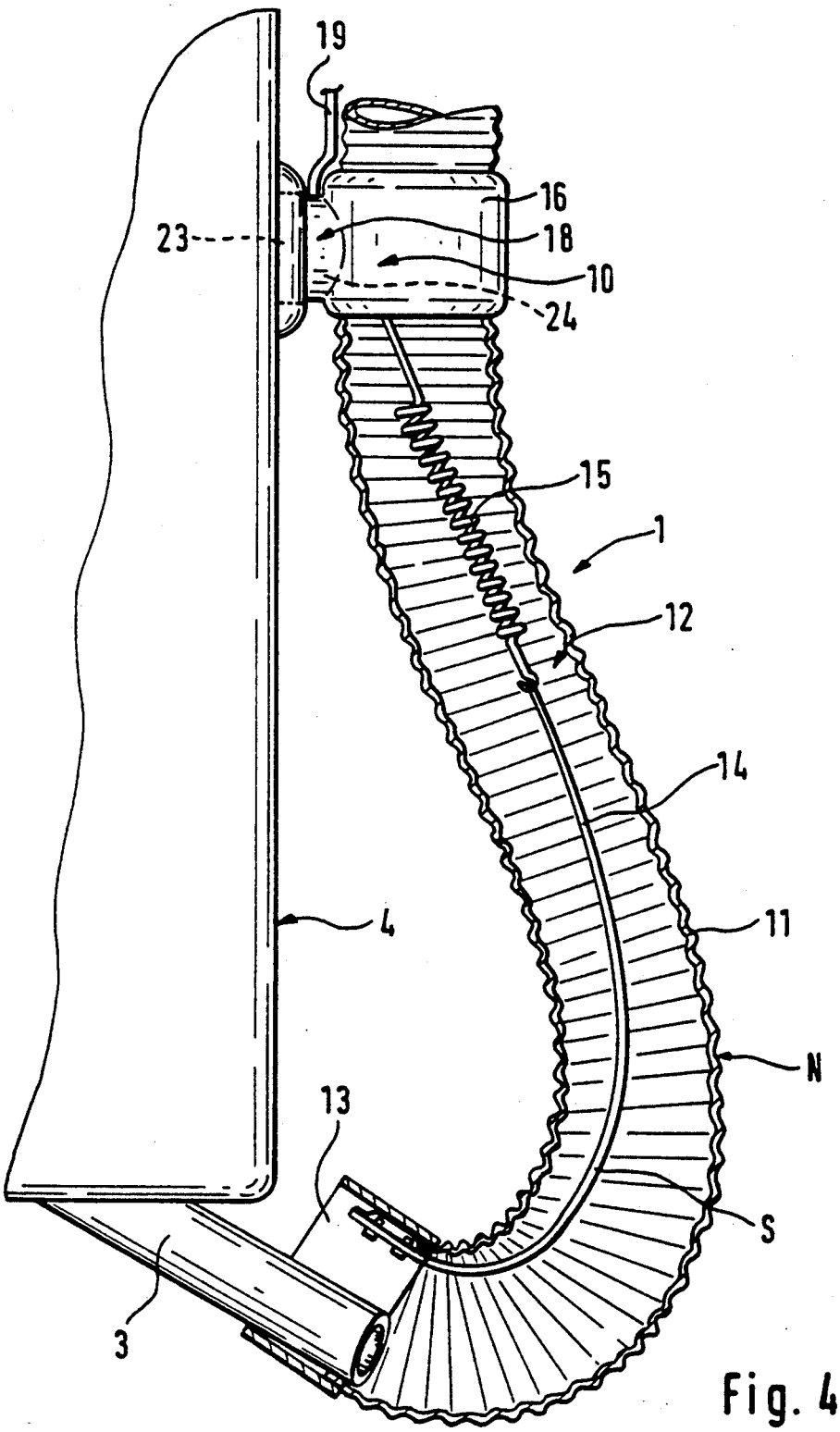
FIG. 4 is a side view, partly in section, illustrating an exhaust suction hose fitted with the device according to the invention and connected to the exhaust pipe of the vehicle.
Figure 7:
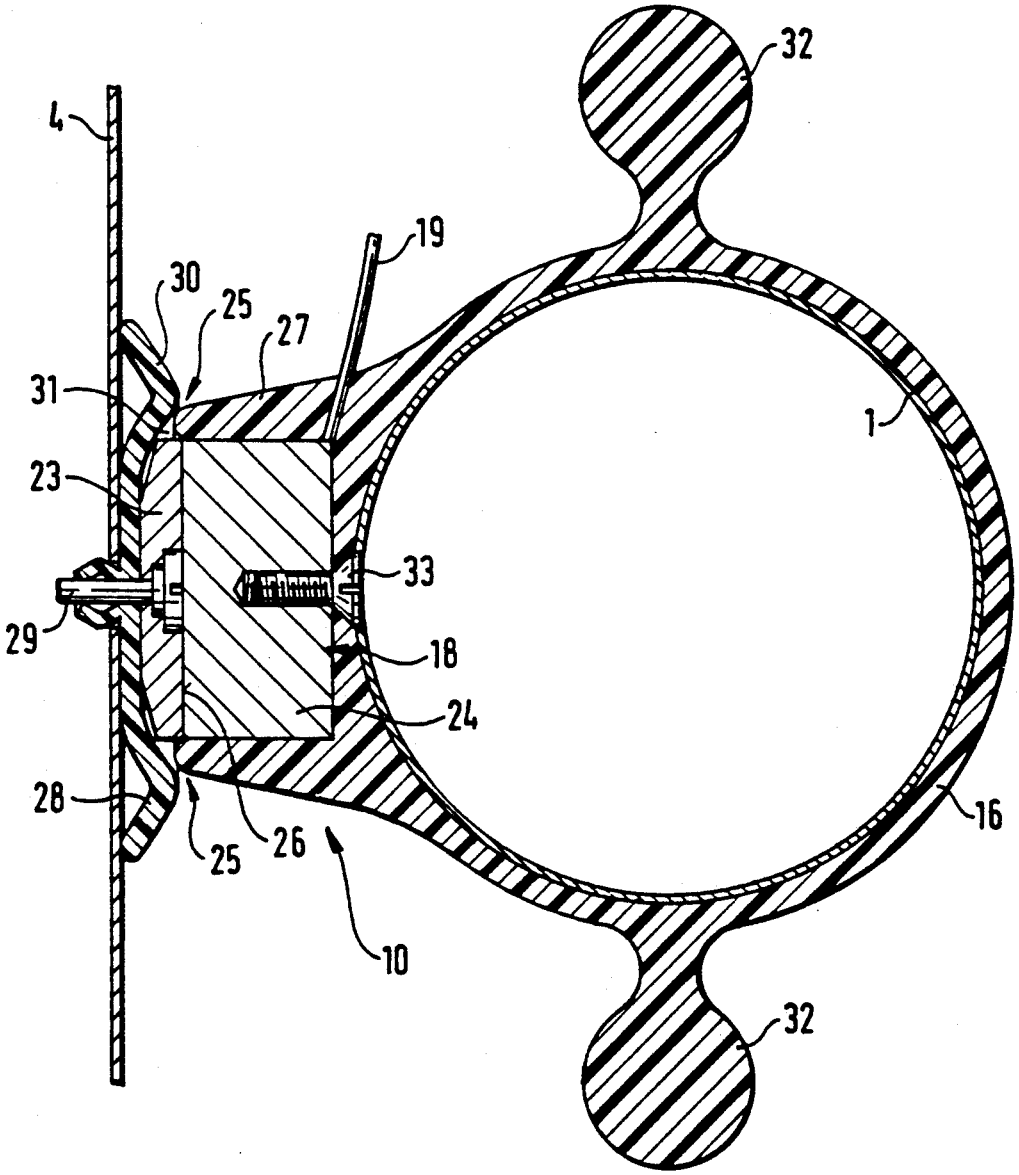
Figure 8:
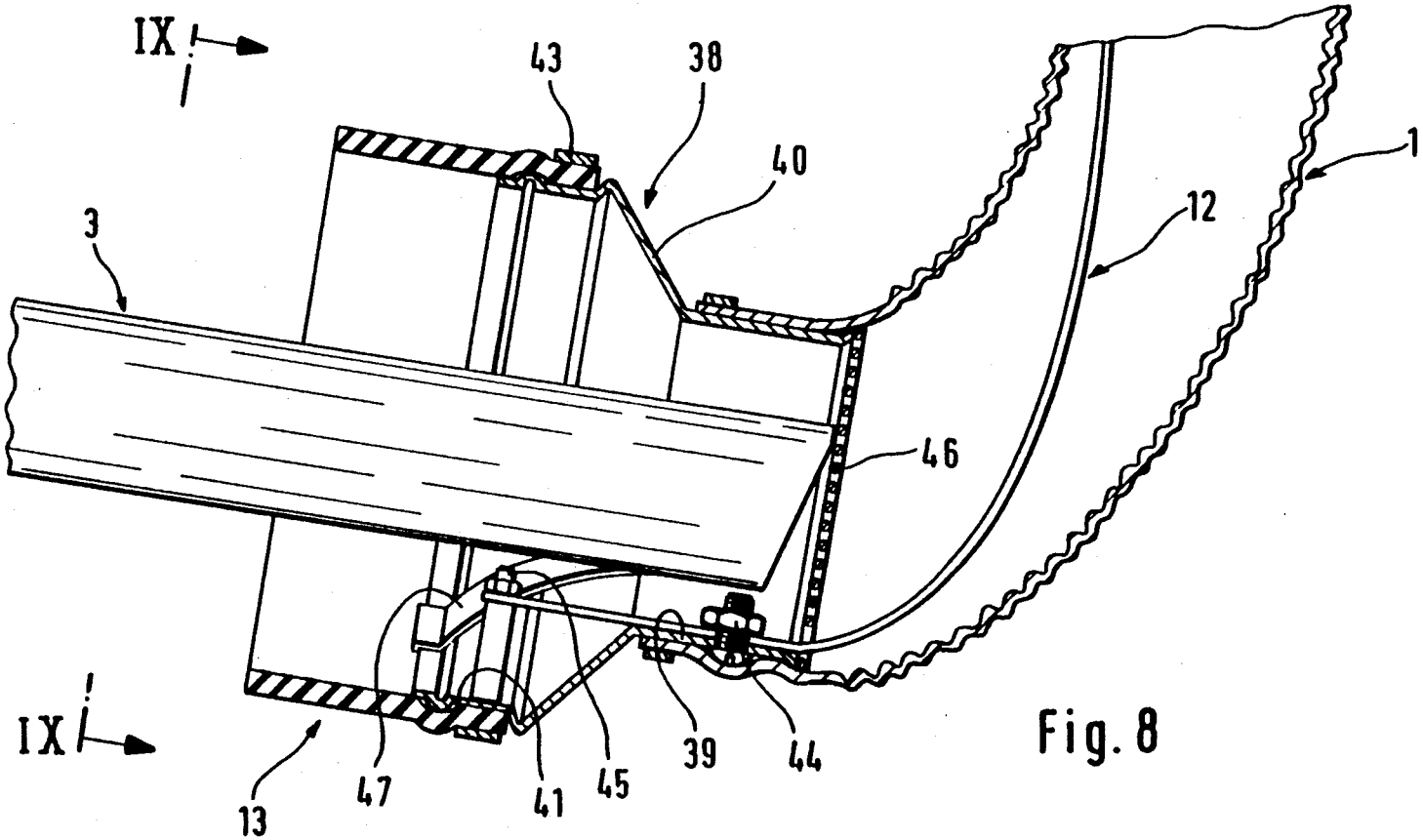
Figure 9:
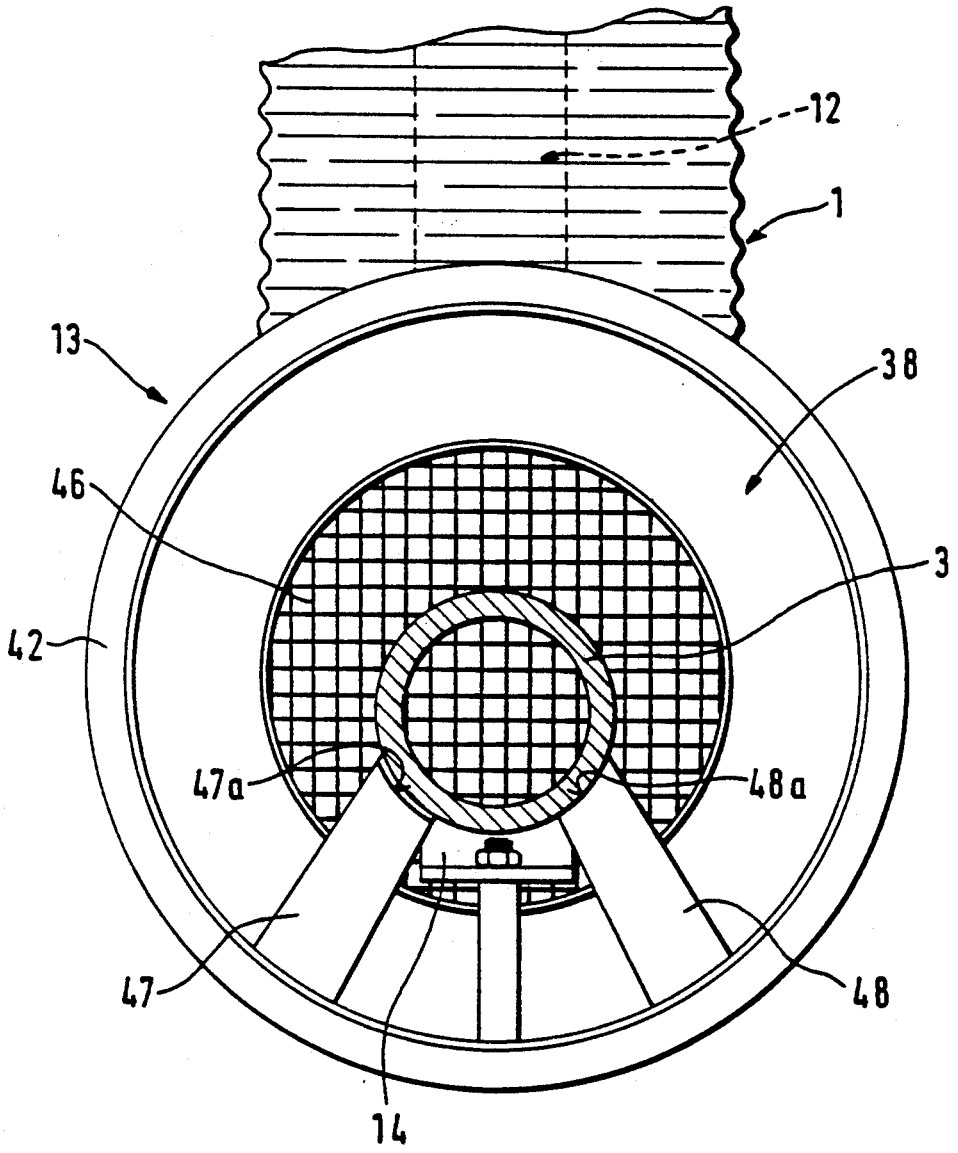

FIG. 5 diagrammatically illustrates an electric coupling device comprised in the device according to the invention;

FIG. 6 is a side view illustrating a holder comprised in the device according to the invention;

FIG. 7 is a section on line VII—VII of the holder according to FIG. 6;

FIG. 8 is a section through an exhaust suction hose connected to an exhaust pipe and fitted with an alternative embodiment of the device according to the invention illustrated in FIG. 1; and FIG. 9 is a view IX—IX of the device according to FIG. 8.

In the drawings, an exhaust suction hose 1 is disposed in a workshop or like premises 2 in order to be connected to an exhaust pipe 3 of a vehicle 4 in said premises 2. The exhaust suction hose is meant to remain on the exhaust pipe when the vehicle is moved within said premises 2 and to be automatically released from the vehicle 4 when the latter is moved out of said premises 2. In this way, it is effectively prevented that the exhaust fumes of the vehicle 4 escape into the premises 2, and it is not necessary to think about uncoupling the exhaust suction hose 1 from the vehicle 4 when it leaves the premises 2.

For the suspension of the exhaust suction hose 1, there is arranged in said premises 2 an overhead runway 5 which preferably begins at a door 2*a* and extends into the premises 2, running above those areas of the premises 2 in which the vehicle 4 is meant to move.

In the embodiment illustrated, the exhaust suction hose 1 presents a continuous part 6 which extends along the runway 5 and is suspended therein at some points with the aid of trolleys 7 which are movable along the runway 5. The part 6 is connected to fan means 8 which is adapted to produce a negative pressure in the exhaust suction hose 1 to suck out the exhaust fumes from the premises 2 via said hose. Before the exhaust fumes are released into the environment they may suitably be cleaned in a filtering assembly (not shown).

From one of the trolleys 7 there depends a part 9 of the exhaust suction hose and said dependent part 9 is adapted for connection to the exhaust pipe 3.

The dependent part 9 of the exhaust suction hose 1 forms and/or cooperates with a tensioning device 12 which permits being tensioned by bending and/or stretching a bendable or stretchable end portion 11 of the exhaust suction hose 1. The tensioning device 12 is destined to retain the end portion 11 to the exhaust pipe 3 by being tensioned when the exhaust suction hose 1 is attached to the vehicle 4 via a fastening device 10 and when the end portion 11 is passed onto the exhaust pipe 3. The exhaust suction hose 1 can be connected by attaching the fastening device 10 to a suitable point of the vehicle 4 and then bending and/or stretching the end portion 11 until it can be passed onto the exhaust pipe 3. At said bending and/or stretching of the end portion 11, the tensioning device 12 is tensioned, retaining in its tensioned state the end portion 11 in position on the exhaust pipe 3. Alternatively, the end portion 11 can first be passed onto the exhaust pipe 3 and then be bent and/or stretched until the fastening device 10 can be attached to the vehicle 4. The tensioning device 12 is tensioned also at this latter bending and/or stretching of the end portion 11.

In its untensioned state the tensioning device 12 preferably maintains the end portion 11 in a bent or contracted condition U, and it can preferably be brought into a straighter shape and/or stretched to a greater length. In the untensioned state, the end portion 11 may besides be bent and contracted in an upward direction and it may be bent downwardly and/or stretched downwardly to the shape N. Thus, in its tensioned state S, the tensioning device 12 will urge that section 13 of the end portion 11, which has been passed onto the exhaust pipe 3 in an upward direction towards the exhaust pipe 3 and said section 13 may be caused to bear against the underside of the exhaust pipe 3, which advantageous if, for some reason or other, the contact made by the section 13 with the exhaust pipe 3 should leave some marks on the exhaust pipe 3.

The tensioning device 12 presents leaf springs means 14 which in the untensioned state is bent to maintain the end portion 11 in its bent state. Besides, the tensioning device 12 has tension and pressure spring means 15 which in its untensioned state is contracted, thereby keeping the end portion 11 contracted. The tension and pressure spring means 15 has its upper end attached to a holder 16 which is adapted to retain the fastening device 10 to the dependent part 9 of the exhaust suction hose 1. The upper end of the leaf spring means 14 is disposed on the lower end of the tension and pressure spring means 15 and the lower end of the leaf spring means 14 is disposed on the section 13.

The spring means 14, 15 of the tensioning device 12 are placed in their entirety within the end portion 11 of the exhaust suction hose 1 while the leaf spring means 14 can have its lower end secured, with the aid of suitable fastening elements 17, to a sleeve which forms the section 13 of the end portion 11. This sleeve in turn may be attached to the exhaust suction hose 1 with the aid of the same fastening elements 17 that retain the leaf spring means 14 to the sleeve. Because the leaf spring means 14 is located at the top of the section 13, the lower portions of the section 13, which are adapted to bear against the exhaust pipe 3, will be devoid of any parts that might damage the surface of the exhaust pipe 3.

The leaf spring means 14 may be secured to the fastening device 10 through a chain (not shown) or similar, such that its length may vary by removing or adding links to the chain.

The fastening device 10 presents an electromagnet 18, which is normally in operation to permit being attached to a vehicle 4 when this is driven into the premises 2. The operation of the electromagnet 18 is unterrupted when the vehicle 4 is driven out of the premises, and this preferably occures when the exhaust pipe 3 of the vehicle 4 is outside the premises 2 or in the vicinity of the door 2*a*. The electromagnet 18 preferably is part of a circuit 19 having a circuit breaking device 20 which is connected in a suitable manner to the exhaust suction hose 1 so that the circuit breaking device 20 moves together with the exhaust suction hose 1 when the latter is coupled to a moving vehicle 4. The circuit breaking device 20 may for instance be connected to a trolley 7 and it includes a movable breaking means 21 which is caused to tilt laterally (see FIG. 5) when the circuit breaking device 20 reaches an abutment 22 at the movement of the exhaust suction hose 1 when the vehicle 4 is driven out of the premises 2. As soon as the breaking means 21 is caused to tilt laterally when it reaches the abutment 22, the current of the circuit 19 is broken whereby the electromagnet 18 becomes dead and thus lets go of the vehicle 4. As the electromagnet 18 lets go of the vehicle, the exhaust suction hose 1 will slide off the exhaust pipe 3 if the vehicle 4 continues to move and the tensioning device 12 will revert to its untensioned state whereby it bends, pulling the end portion 11 upwards.

When the circuit breaking device 20 has passed the abutment 22, the breaking means 21 is caused to tilt upwards into initial position, the circuit 19 being thus closed again and the electromagnet 18 being again put in operation. As a result, the exhaust suction hose 1 can immediately be coupled with the aid of the electromagnet 18 to a vehicle 4 that is driven into the premises 2, as soon as said hose 1 has been released from the vehicle 4 that was driven out of said premises. When the circuit breaking device 20 passes the abutment 22 while moving in the opposite direction, i.e. the direction in which the exhaust suction hose 1 moves when it is pulled by a vehicle driven into the premises 2, the breaking means 21 will not break the circuit 19 and therefore the electromagnet 18 does not come loose from the vehicle 4 when driven into the premises 2.

On vehicles 4 that shall permit connection thereto of the exhaust suction hose 1, there is preferably provided a fastening means 23, which is spaced such a distance from the exhaust pipe 3 that the tensioning device 12 is tensioned sufficiently firm when a magnet body 24 of the electromagnet 18 has been applied against the fastening means 23 and kept attached to said means by its magnetic force and when the exhaust suction hose 1 has been passed onto the exhaust pipe 3. The magnet body 24 and/or the fastening means 23 may be so arranged and/or designed that the magnet body 24 by reason of its magnetic force can be kept attached only to the fastening means 23 but not to other parts of the vehicle 4. On the holder or at another suitable location, there may be provided elements 25 that prevent retention and are adapted to prevent the magnet body 24 from keeping attached to parts of the vehicle 4 other than the fastening means 23. These retention-preventing elements 25 protrude beyond such outer parts 26 of the magnet body 24 that preferably constitute a planar abutment surface and are adapted to bear against the fastening means 23. The retention-preventing elements 25 are preferably formed by the outer parts of an annular collar 27 of the holder 16. The magnet body 24 is disposed in said annular collar 27.

The fastening means may preferably be mounted for rotation about a horizontal axis 29, whereby the exhaust suction hose 1 can turn somewhat in relation to the vehicle 4, if necessary.

The fastening means 23 is preferably disposed on the vehicle 4 via a washer 28 of plastic material or other suitable material. Said washer 28 as well as the fastening means 23 may be fastened in that the axis 29 serves as a fastening means. The washer 28 has slightly upwards directed protective portions 30 which constitute the edge portions of the washer 28 and extend all around the fastening means 23. Between the outer edge of the fastening means 23 and the protective portions 30 there is formed a space 31 in which the retention-preventing elements 25 are accommodated, which implies that said elements 25 do not prevent the magnet body 24 from moving into contact with the fastening means 23 since the elements 25 can be pushed into the space 31.

The retention-preventing elements 25 and the space 31 also permit guiding the magnet body 24 in a simple manner into the correct position on the fastening means 23.

The holder 16 of the electromagnet 18 may be annular. It is wrapped around the exhaust suction hose 1 at a suitable point and tightened about said hose. The holder 16 may have handles 32 and the magnet body 24 of the eletromagnet 18 may be attached to the holder 16 by means of suitable fixation means 33, such as screws. The cables of the circuit may be placed inside or on the outside of the exhaust suction hose 1.

On one of the trolleys 7 there is suitably mounted a hoisting device 34 including a rope 35 or the like, running over a return pulley 36 and via a bent pipe section 37 down into the dependent part 9 of the exhaust suction hose 1. The rope 35 may run inside or outside the part 9 and said rope is suitably attached to the holder 16 or otherwise connected to the end portion 11 and/or the tensioning device 12. The hoisting device presents spring means (not shown) which is tensioned when the rope is pulled downwards and said spring means is adapted automatically to haul up the end portion 11 in relation to the floor when the exhaust suction hose 1 lets go of the vehicle 4.

As the exhaust suction hose 1 has an essentially larger inner diameter than the exhaust pipe 3 it may—in addition to being used with simple exhaust pipes having small or large outer diameters—also be passed onto oval, four-sided and double-barrelled exhaust pipes.

Since the tensioning device retains the exhaust suction hose 1 to the exhaust pipe 3, the hitherto necessary retaining rods, which were clamped to the exhaust pipe and might damage it, are also dispensed with.

By the fact that the fastening device 10 can be fixed to the vehicle 4 at a rather large distance above the exhaust pipe 3, the activation of the tensioning device is facilitated.

In FIGS. 8 and 9 there is shown an example of how the section 13 of the exhaust suction hose 1 adapted to be passed onto the exhaust pipe 3 may be designed. Thus, said section 13 includes a pipe piece 38 of preferably metallic material. This pipe piece 38 has an inner portion 39 onto which the exhaust suction pipe 1 is passed and secured, and which through a funnel-shaped portion 40 transforms into an outer portion 41 with a substantially larger diameter than said inner portion 39. A sleeve 42 of rubber material or another sufficiently soft material is passed onto the outer portion 41 of the pipe piece 38 and this sleeve 42 is in a suitable manner secured to said outer portion 41 by means of e.g. a clamping ring 43.

The sleeve 42 is int. al. adapted to give section 13 a soft outer end and the pipe piece 38 and the sleeve 42 preferably have such a large diameter that air from the surroundings is sucked into the exhaust suction hose 1 at the same time as the exhausts.

The leaf spring means 14 of the tensioning device 12 is preferably fastened at the bottom of the pipe piece 38 and it is hereby achieved that the section 13 can not transform into an oval shape when connected and while said leaf spring means 14 is attached to a shape permanent pipe piece 38, it is ensured that it does not loosen. The anchoring of the leaf spring means 14 in the pipe piece 38 may be realized by means of bolts 44, 45 or other suitable fastening means.

At the inner edge of the pipe piece 38 or at another suitable location inside said section 13, there may be provided a net 46 or the like, which prevents the exhaust pipe 3 from penetrating so far into said section 13 that the hose above said section 13 is damaged.

The pipe piece 38 includes two yoke shaped friction elements 47 and 48 which engage the exhaust pipe 3 from below when said pipe protrudes into said section 13. One friction element 47 has an upper high-frictional surface **47*a* and the other friction element 48 and upper frictional surface 48*a* with substantially lower friction properties. These friction elements 47, 48 are located such that only the friction element 47 engages the exhaust pipe 3 with its frictional surface 47*a* or at least that said friction element 47 bear against the exhaust pipe 3 with a higher pressure than the outer friction element 48 when the vehicle is driven about in the premises. However, when the vehicle leaves said premises and reaches a position at which the exhaust suction hose 1 shall be disconnected, said hose changes its position relative to the exhaust pipe 3 such that said other friction element 48 is pressed against said exhaust pipe 3 or increases its pressure thereagainst while the friction element 47 ceases to engage said exhaust pipe 3 or reduces its pressure thereagainst. Since the frictional surface 48*a* of said other friction element 48 has a lower friction coefficient than the frictional surface 47*a* of the friction element 47, the friction element 48 may easily slide off the exhaust pipe 3, which means that said friction element 47 ensures a firm grip on the exhaust pipe 3 when required and said other friction element 48 a poorer grip when the exhaust suction hose 1 shall slide off the exhaust pipe 3** and vice versa.

The invention is not restricted to the device described above but can be varied within the scope of the appendant claims. As examples of alternative embodiments, it may be mentioned that the hose proper may be of a type other than that illustrated and that it may for instance hang from a so-called suction trolley which communicates with an exhaust suction rail along which the trolley moves.

The fastening device 10 may be of any other suitable type than an electromagnet. Thus, use may be made of a suction cup in which a negative pressure is produced to keep it attached to the vehicle. The negative pressure is abolished when it is desired that the suction cup shall let go. A further conceivable variant is a hook which is firmly secured to the vehicle and which is raised so as to release its hold.

The spot where the fastening device 10 is applied to the vehicle 4 need not necessarily be a single definite point thereon, but the fastening device 10 may be attachable to a few different spots on the vehicle 4 provided that these spots are situated at a height above the exhaust pipe 3 greater than the height of the end portion 11 when it is bent and/or contracted.

It is not either absolutely necessary to arrange a fastening means 23 on the vehicle 4. Instead, the fastening device 10 may be designed in such a way as to permit being fixedly mounted at a suitable point of the vehicle 4 without any fastening means 23.

The design of the tensioning device 12 may also vary without departing from its function. Thus, it may consist of or comprise other types and another number of spring means 14, 15 than those illustrated and they may be secured in another manner than that illustrated. It is also conceivable to locate spring means outside instead of inside the hose. Another alternative is that the hose proper constitutes a tensioning device cooperating or not with special springs; this may be realized by so designing parts of the hose—for instance coil wire of the like—that the hose is given a bent and/or contracted normal shape, to which it tends to revert when it is bent and/or stretched.

It is not either absolutely necessary for the end portion 11 to have a tensioning device 12 throughout its length and/or for the entire end portion 11 to be bendable and/or stretchable.

The section 13 of the end portion 11 may be an end portion of the exhaust suction hose proper instead of being a separate sleeve. IT is essential that the section 13 is so soft that it does not damage the exhaust pipe or other details.

In the electromagnet embodiment the outer surfaces of the fastening means 23 and the washer 28 are preferably coplanar in order to facilitate keeping the surface of the fastening means 23 clean.

The holder 16 may be a socket to which the exhaust suction hose 1 is connected at the upper and the lower end.

The fastening device is attached to the vehicle in dependence on the vehicle type concerned. Thus, the fastening device may be attached to one of the long sides of the vehicle with some vehicle types or for instance on the rear parts of the vehicle with other vehicle types.

It should finally be mentioned that the device according to the invention is useful in many different kinds of premises in which vehicles are driven. By way of example there may be mentioned fire stations, garages, car inspection premises etc.

I claim:

1. A device for connecting an exhaust suction hose (1) to the exhaust pipe (3) of a vehicle (4) in such a way that the exhaust fumes of the vehicle (4) are carried away via the exhaust suction hose (1), said exhaust suction hose (1) being disposed at the top of a workshop or like premises (2) and a dependent part (9) of the exhaust suction hose (1) being connectable to the exhaust pipe (3) of a vehicle (4) in said premises (2), the exhaust suction hose (1) being kept connected to the exhaust pipe (3) while the vehicle (4) is driven about in said premises (2), and the exhaust suction hose (1) being automatically released from the exhaust pipe (3) when the vehicle (4) is driven out of said premises (2), characterized by the fact that the exhaust suction hose (1) has combined with it a tensioning device (12) having an untensioned state at which it holds an end portion (11) of the exhaust suction hose (1) in a given condition, which tensioning device may be shifted to a tensioned state by deflecting the end portion (11) from said given condition, and which tensioning device retains the end portion (11) to the exhaust pipe (3) by being tensioned when the exhaust suction hose (1) is attached to the vehicle (4) via a fastening device (10) and when the end portion (11) is passed onto the exhaust pipe (3).

2. A device as claimed in claim 1, characterized by the fact that the tensioning device (12) in the untensioned state keeps the end portion (11) of the exhaust suction hose (1) in a bent and contracted condition and that the end portion (11), after the fastening device (10) has been attached to the vehicle (4), is passed onto the exhaust pipe (3) and brought to a different condition at which tensioning device (12) is in a tensioned state.

3. A device as claimed in claim 2, characterized by the fact that the fastening device (10) is disposable at a definite spot of the vehicle (4) located above the exhaust pipe (3), that the tensioning device (12) in the untensioned state keeps the end portion (11) in an upwardly bent and upwardly contracted condition (U), that the end portion (11) is passed onto the exhaust pipe (3) in a straightened and stretched state (N), and that the tensioning device (12) in the tensioned state (S) urges a section (13) of the exhaust suction hose (1) that has been passed onto the exhaust pipe (3), in an upward direction against the underside of the exhaust pipe (3).

4. A device as claimed in claim 1, characterized by the fact that the tensioning device (12) presents leaf spring means (14) of bent shape in its untensioned state to keep the end portion (11) of the exhaust suction hose (1) in a bent state, and that the tensioning device (12) also presents tension and pressure spring means (15) which is contracted in its untensioned state and keeps the end portion (11) in a contracted state.

5. A device as claimed in claim 4, characterized by the fact that the tension and pressure spring means (15) and the leaf spring means (14) are connected together, the tension and pressure spring means (15) being also connected with a holder (16) mounted on the exhaust suction hose (1) to keep the fastening device (10) fastened to the exhaust suction hose (1), and the leaf spring means (14) being also connected with a section (13) of the exhaust suction hose (1) to be fitted onto the exhaust pipe (3).

6. A device as claimed in claim 1, characterized by the fact that the parts (14, 15) comprised in the tensioning device (12) are placed inside the end portion (11) of the exhaust suction hose (1).

7. A device as claimed in claim 1, characterized by the fact that the fastening device (10) presents san electromagnet (18) disposed on the exhaust suction hose (1), said electromagnet (18) being normally in operation to permit being attached to a vehicle (4) in said premises (2) and the operation thereof being automatically unterrupted to cause the electromagnet (18) to let go of the vehicle (4) when it is driven out of said premises (2).

8. A device as claimed in claim 7, characterized by the fact that the electomagnet (18) is part of a circuit (19) having a circuit breaking device (20) which is adapted to move in said premises (2) together with the exhaust suction hose (1) when the latter is coupled to a driven vehicle (4), and that the circuit breaking device (20) is adapted to break the circuit (19) and thus the operation of the electromagnet (18) when a breaking means (21) in said circuit breaking device engages an abutment (22) when the vehicle (4) carries along the exhaust suction hose (1) as it is driven out of said premises (2).

9. A device as claimed in claim 8, characterized by the fact that the breaking means (21) is adapted to close the circuit (19) again and thus to put the electromagnet (18) in operation again when the breaking means (21) has passed the abutment (22) when the exhaust suction hose (1) and the circuit breaking device (20) move in the same direction as in which vehicles (4) are driven out of said premise (2), and that the breaking means (21) is adapted to maintain the circuit (19) closed and thus the electromagnet (18) in operation when the circuit breaking device (20) passes the abutment (22) in the opposite direction.

10. A device as claimed in claim 7, characterized by the fact that the electromagnet (18) has a magnet body (24) which is adapted to be applied against and to be kept attached by its magnetic force to a fastening means (23) disposed on a vehicle (4) to the exhaust pipe (3) of which the exhaust suction hose (1) is to be coupled, and that at least one of the magnet body (24) and the fastening means (23) is so designed that the magnet body (24) can keep attached by its magnetic force only to the fastening means (23) but not to other parts of the vehicle (4).

11. A device as claimed in claim 10, characterized by the fact that retention-preventing elements (25) which are adapted to prevent the magnet body (24) from keeping attached to parts of the vehicle (4) other than the fastening means (23), protrude beyond such outer parts (26) of the magnet body (24) that are adapted to bear against the fastening means (23).

12. A device as claimed in claim 11, characterized by the fact that the retention-preventing elements (25) are formed by outer parts of an annular collar (27) in which the magnet body (24) is placed, and that the fastening means (23) is arranged on a washer (28) having protective portions (30) that extend around the fastening means (23) and that provide such a free space (31) around the fastening means (23) that the retention-preventing elements (25) are accommodated therein, whereby said space (31) allows the magnet body (24) to be applied against the fastening means (23) in that the retention-preventing elements (25) can be pushed into said free space (31).

13. A device as claimed in claim 10, characterized by the fact that the fastening means (23) is mounted for rotation about a horizontal axis (29).

14. A device as claimed in claim 10, characterized by the fact that the fastening means (23) is placed on the vehicle (4) at a height over the exhaust pipe (3) greater than the height of the end portion (11) of the exhaust suction hose (1) when the tensioning device (12) keeps said end portion in the bent and contracted state.

15. A device claimed in claim 10, characterized by the fact that the electromagnet (18) is arranged on a preferably annular holder (16) which is adapted to be placed about the exhaust suction hose (1) and fixed thereto.

16. A device as claimed in claim 15, characterized by the fact that the tensioning device (12) is connected with the preferably annular holder (16).

17. A device as claimed in claim 1, characterized by the fact that the end portion (11) of the exhaust suction hose (1) is connected with a hoisting device (34) which permits said end portion to be hauled down against the action of at least one spring means in the hoisting device (34), and that the hoisting device (34) with the aid of said spring means automatically pulls up the end portion (11) in relation to the floor when the exhaust suction hose (1) lets go of the vehicle (4).

18. A device as claimed in claim 17, characterized by the fact that the end portion (11) is connected with the hoisting device (34) via a holder (16) on which the fastening device (10) as well as the tensioning device (12) are disposed.

19. A device as claimed in claim 1, characterized by the fact that inside a section (13) of the exhaust suction hose (1) which can be passed onto the exhaust pipe (3) there is provided a net (46) for preventing said exhaust pipe from penetrating so far into said section (13) that the exhaust suction hose (1) thereabove is damaged.

20. A device as claimed in claim 1, characterized by the fact that a section (13) of the exhaust suction hose (1) which can be passed onto the exhaust pipe (3) is so much larger than an exhaust pipe (3) protruding into said section (13), that air from the surroundings is sucked into the exhaust suction hose (1) at the same time as exhausts from the exhaust pipe (3).

21. A device as claimed in claim 1, characterized by the fact that the tensioning device (12) is attached at the bottom of a section (13) of the exhaust suction hose (1) which can be passed onto the exhaust pipe (3).

22. A device as claimed in claim 1, characterized by the fact that inside a section (13) of the exhaust suction hose (1) which can be passed onto the exhaust pipe (3) there is provided a first frictional surface (47*a*) which engages the exhaust pipe (3) when the vehicle is driven about in said premises (2) and a second frictional surface (48*a*) having a lower friction coefficient than said first frictional survace (47*a*) and bearing against the exhaust pipe (3) when the vehicle has reached a position at which the exhaust suction hose (1) shall be released from said exhaust pipe (3).

* * * * *